US005419544A

United States Patent [19]

Ono et al.

[11] Patent Number: 5,419,544

[45] Date of Patent: May 30, 1995

[54] PAPER CASSETTE AND PAPER CASSETTE INSERTION MECHANISM

[75] Inventors: Ichiro Ono; Masahiro Fukuda; Shigeki Nakajima, all of Tokyo, Japan

[73] Assignee: Oki Electric Industry Co., Ltd., Tokyo, Japan

[21] Appl. No.: 180,415

[22] Filed: Jan. 12, 1994

[30] Foreign Application Priority Data

Jan. 18, 1993 [JP] Japan ..... 5-005996

[51] Int. Cl.[6] ..... B65H 1/22

[52] U.S. Cl. ..... 271/164; 271/160; 271/157; 271/167

[58] Field of Search ..... 271/157, 160, 162, 164, 271/167

[56] References Cited

U.S. PATENT DOCUMENTS 4,280,692 7/1981 Hutchinson et al. ..... 271/160
5,232,215 8/1993 Hashimoto et al. ..... 271/160
5,338,021 8/1994 Shirai ..... 271/160

FOREIGN PATENT DOCUMENTS 0203024 11/1984 Japan ..... 271/157
3162328 7/1991 Japan ..... 271/162
4333434 11/1992 Japan ..... 271/157

*Primary Examiner*—H. Grant Skaggs
*Assistant Examiner*—Carol L. Druzbick
*Attorney, Agent, or Firm*—Steven M. Rabin

[57] ABSTRACT

A paper cassette comprises a paper stack tray provided on a cassette body, a stack tray locking mechanism for locking the paper stack tray and releasing the lock when the cassette is inserted into the cassette receptacle, and a first restoring member for pushing the paper stack tray toward a supply roller and bringing the paper when the lock of the stack tray locking mechanism is released. The stack tray locking mechanism comprises a pivot member provided on the cassette body such that the pivot member is free to pivot, a locking member which engages with the pivot member, and engages the paper stack tray in the locked position, and a second restoring member for pushing the pivot member in such a direction that the pivot member comes in contact with the supply roller so as to engage the locking member with the paper stack tray. The pivot member comes into contact with the supply roller so as to cause the pivot member to pivot and release the lock of the paper stack tray due to the locking member when the cassette is inserted into the cassette receptacle.

21 Claims, 13 Drawing Sheets

PAPER CASSETTE AND PAPER CASSETTE INSERTION MECHANISM

BACKGROUND OF THE INVENTION

The present invention relates to a paper cassette which is inserted in the paper feed mechanism of an electrophotographic printer or the like, and a paper cassette insertion mechanism for such a paper cassette.

FIG. 14 is a vertical section showing a conventional paper cassette 3, and FIG. 15 is a vertical section showing a conventional electrophotographic printer 1 into which the paper cassette 3 of FIG. 14 is inserted.

As shown in FIG. 14, in a conventional paper cassette 3, when paper 6 is to be stacked in the paper cassette 3, a paper stack tray 9 which is free to pivot about an axis 11 in the direction A-B is locked parallel to the baseplate 12. A locking member 15, which is pushed in the cassette insertion direction (direction D) by a compressed coil spring 16, is then engaged with a hook 14 provided on a lower surface of the paper stack tray 9.

When the paper cassette 3 is press-inserted in direction D into the cassette receptacle 4 of a housing 2 of the printer 1, as shown in FIG. 15, a projection **15*b* on a lower surface of the locking member 15 comes into contact with a stack tray release member 17 provided in the cassette receptacle 4, and the locking member 15 undergoes a relative displacement in the cassette ejection direction (direction C) so that the paper stack tray 9 is no longer locked. The paper stack tray 9 is then pushed upward by a coil spring 13 (direction A) so as to press the paper 6 against the supply roller 7. A paper separating member 10 also comes into contact with the supply roller 7, and when the supply roller 7 rotates, the paper 6 stacked in the cassette 3 is ejected via a paper guide 8 one sheet at a time to the printing assembly 5**.

When the paper cassette 3 is removed from the cassette receptacle 4, it is pulled out in the direction C by gripping a tag 18 on the paper cassette 3.

However, in this conventional paper cassette 3, the coil spring 16 is kept compressed while the paper cassette 3 is inserted in the cassette receptacle 4. The coil spring 16 therefore tends to suffer fatigue so that its restoring force in the direction D declines, and the paper stack tray 9 can no longer be locked.

Moreover, as the paper cassette 3 is provided with the hook 14, the locking member 15 and the lock release member 17 on its lower surface, the cassette receptacle 4 has to be thicker, and devices such as printers into which the paper cassette was inserted could not easily be made thin.

Again, in conventional cassette insertion mechanisms, the cassette was removed by gripping the tag 18, so the user's nails sometimes break during the operation.

SUMMARY OF THE INVENTION

It is therefore an object of the present invention to provide a paper cassette wherein the stack tray locking mechanism does not easily break down, and product life is longer.

It is a further object of the present invention to provide a paper cassette which permits printers and other devices having a paper feed mechanism to be made thinner.

It is a still further object of the present invention to provide a paper cassette insertion mechanism wherein removal of the paper cassette is easy.

According to one aspect of the present invention, a paper cassette, which is inserted by sliding into a cassette receptacle of a paper feed mechanism having a supply roller for supplying paper, comprises a cassette body; a paper stack tray arranged such that the paper stack tray is free to move with respect to the cassette body; a stack tray locking mechanism for locking the paper stack tray in a position close to a baseplate of the cassette body, and releasing the lock when the paper cassette is inserted into the cassette receptacle; and a first restoring member for pushing the paper stack tray toward the supply roller and bringing the paper stacked in the paper stack tray in contact with the supply roller when the lock of the stack tray locking mechanism is released. The stack tray locking mechanism comprises a pivot member provided on the cassette body such that the pivot member is free to pivot, the pivot member being able to come into contact with the supply roller; a locking member which engages with the pivot member and engages the paper stack tray in the locked position; and a second restoring member for pushing the pivot member in such a direction that the pivot member comes in contact with the supply roller so as to engage the locking member with the paper stack tray. The pivot member comes into contact with the supply roller so as to cause the pivot member to pivot and release the lock of the paper stack tray due to the locking member when the paper cassette is inserted into the cassette receptacle.

According to another aspect of the present invention, a paper cassette, which is inserted by sliding into a cassette receptacle of a paper feed mechanism, comprises a cassette body; a paper stack tray provided such that the paper stack tray is free to move with respect to the cassette body; a stack tray locking mechanism for locking the paper stack tray in a position close to a baseplate of the cassette body and releasing the lock when the paper cassette is inserted into the cassette receptacle; and a first restoring member for pushing the paper stack tray upward and bringing the paper stacked in the paper stack tray in contact with a supply roller when the lock of the stack tray locking mechanism is released. The stack tray locking mechanism comprises a locking member provided on an inner surface of a side wall of the cassette body, the locking member engaging with the paper stack tray in the locked position; and a guide pin provided on an upper part of the locking member which come into contact with a predetermined part of the cassette receptacle when the paper cassette is inserted, thereby causing the locking member to slide toward the side wall whereon the locking member is attached so as to release the lock of the paper stack tray.

According to still another aspect of the present invention, a paper cassette insertion mechanism comprises a cassette receptacle in a paper feed mechanism and a paper cassette which is inserted in the cassette receptacle, the paper cassette being inserted from a cassette insertion port of the cassette receptacle in a predetermined insertion direction. The cassette receptacle comprises a restoring member provided in the cassette receptacle for pushing the paper cassette in an ejection direction opposite to the insertion direction; and a cassette lock lever for fixing the paper cassette at a predetermined position when the cassette lock lever is pushed in the ejection direction by the restoring member. The paper cassette comprises a cassette lock cam for engaging with the cassette lock lever. The paper cassette is inserted by pushing it into the cassette receptacle by hand from the cassette insertion port and removing the hand, thereby the cassette lock lever engages with the cassette lock cam; and when the inserted cassette is pushed by hand, the cassette lock lever and the cassette lock cam are disengaged, and when the hand is removed, the paper cassette is ejected from the cassette insertion port due to the restoring force of the restoring member.

DETAILED DESCRIPTION OF THE INVENTION

A preferred embodiment of the paper cassette and the paper cassette insertion mechanism will now be described with reference to the drawings.

Figure 1:
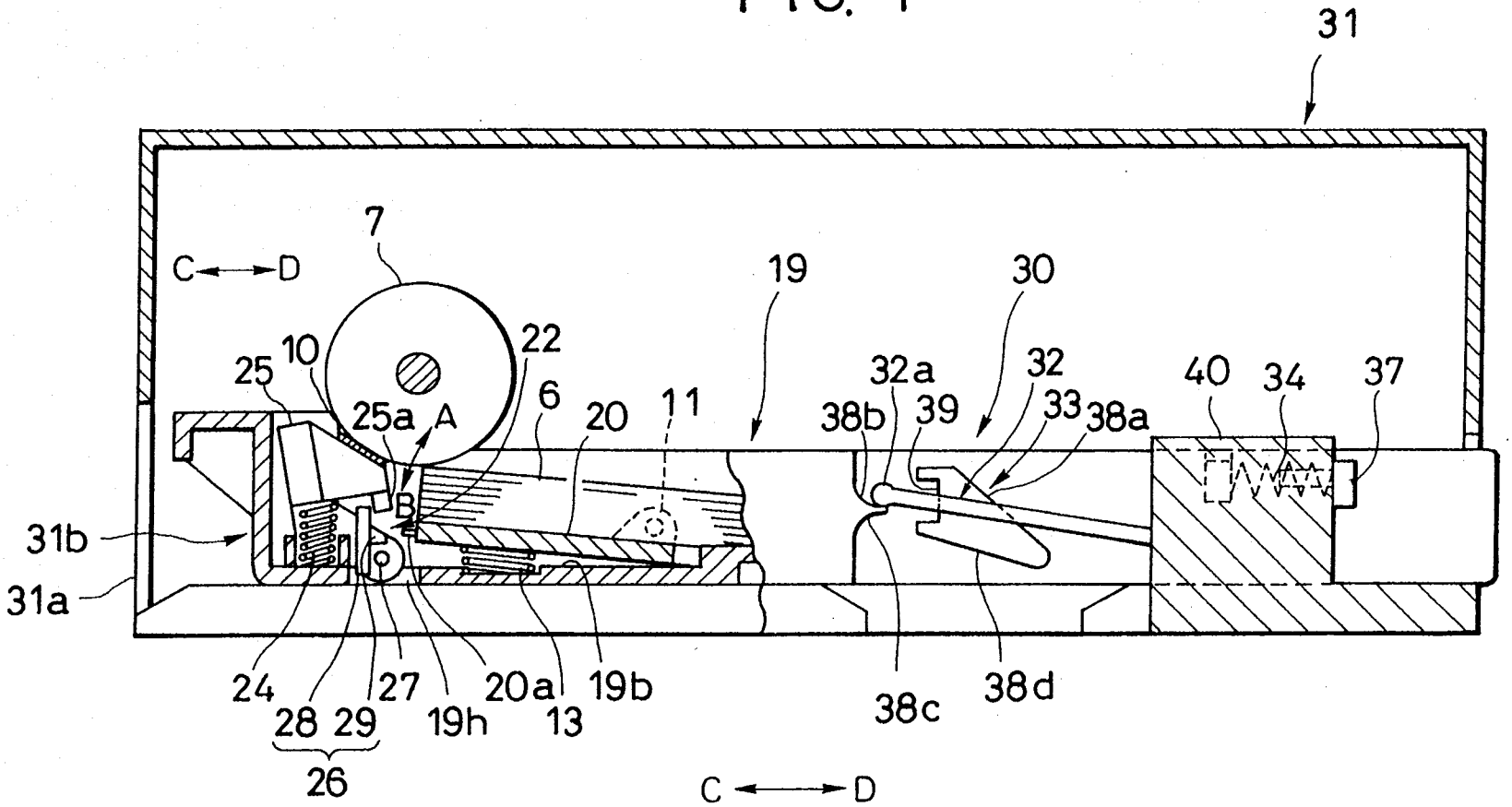
FIG. 1 is a vertical section showing the schematic layout of an electrophotographic printer incorporating one embodiment of a paper cassette and a paper cassette insertion mechanism according to the present invention.
Figure 2:
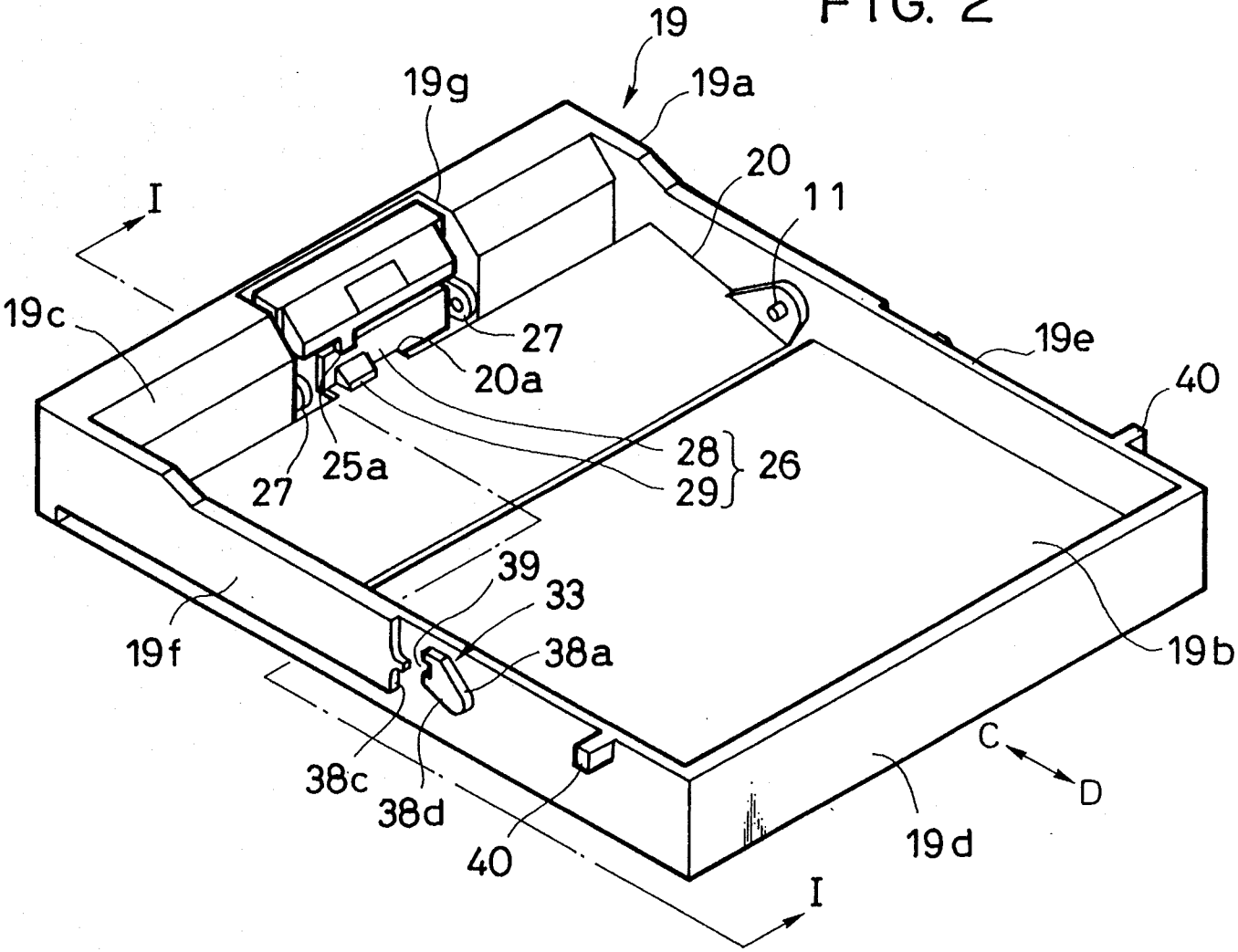
FIG. 2 is a perspective view of the outer aspect of the paper cassette in FIG. 1.

FIG. 1 is a vertical section showing the layout of an electrophotographic printer 31 in which one embodiment of a paper cassette 19 and a paper cassette insertion mechanism are installed. In FIG. 1, the printing part for printing an image on the paper 6 is omitted. FIG. 2 is a perspective view of the outer aspect of the paper cassette 19 in FIG. 1. FIG. 1 corresponds to the case where the electrophotographic printer 31 housing the paper cassette 19 is viewed in the direction of the line I—I in FIG. 2.

As shown in FIG. 1 and FIG. 2, the paper cassette 19 of this embodiment is inserted into a predetermined cassette receptacle 31*b* by pressing it from a cassette insertion port 31*a* of the printer 31 in the insertion direction (direction D).

The paper cassette 19, as is best seen from FIG. 2, comprises a cassette body 19*a* having a baseplate 19*b*, a front wall 19*c*, a rear wall 19*d*, and side walls 19*e*, 19*f*, and a paper stack tray 20 which is free to pivot in the direction A-B about a pair of supports 11 respectively fixed to the inner surfaces of the side walls 19*e*, 19*f* opposite each other. This paper stack tray 20 is joined to the cassette body 19*a* such that it pivots about its edge on the cassette insertion side with respect to the cassette body 19*a*, and its edge on the cassette ejection side is situated effectively directly beneath the supply roller 7 of the paper feed mechanism of the printer 31.

The paper cassette 19 comprises a locking mechanism 22 which locks the paper stack tray 20 in a position close to the baseplate 19*b* of the cassette body 19*a* and releases the lock when the paper cassette 19 is inserted in the cassette receptacle 31*b*, together with the compressed coil spring 13 situated between the baseplate 19*b* of the cassette body 19*a* and the paper stack tray 20. This coil spring 13 pushes the free edge of the paper stack tray 20 toward the supply roller 7 (direction A), and when the lock is released by the stack tray locking mechanism 22, the paper 6 which is stacked in the paper stack tray 20 is brought into contact with the supply roller 7.

The stack tray locking mechanism 22 is situated on the cassette ejection side of the paper stack tray 20. The stack tray locking mechanism 22 comprises a pivot member 25 which functions as a paper separating means, and which is free to pivot about a pair of supports 27 fixed opposite to each other in a central recess 19*g* of the front wall 19*c* of the cassette body 19*a*, and a compressed coil spring 24 which pushes the member 25 in an upward direction (direction A) so as to bring a paper separating tag 10 into contact with the supply roller 7.

Figure 3:
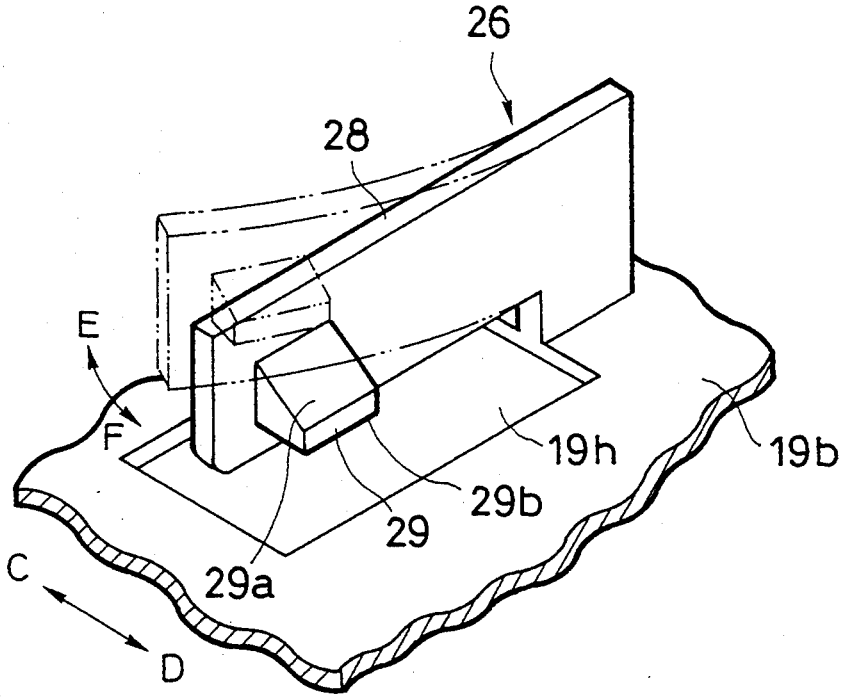
FIG. 3 is an enlargement in perspective of the locking member of the stack tray locking mechanism of the paper cassette in FIG. 1.

The stack tray locking mechanism 22 further comprises a locking member 26 which engages with the pivot member 25. As shown in FIG. 3, one edge of this locking member 26 is fixed to the circumference of a hole 19*h* in the baseplate 19*b* of the cassette body 19*a*. The locking member 26 comprises a flat spring 28 which is parallel to the baseplate 19*b* and positioned in a direction perpendicular to the cassette insertion direction (direction D), and a locking claw 29 situated on the free end of the flat spring 28 which engages with an end projection 20*a* on the cassette ejection side of the paper stack tray 20. This flat spring 28 is normally oriented perpendicular to the cassette insertion direction (direction D) as shown by the solid line in FIG. 3, but it can be bent in a horizontal direction (direction E) as shown by the double dotted broken line in FIG. 3. Further provided is an engaging claw 25*a* facing downward on the pivot member 25 which engages with the flat spring 28 of the locking member 26, and which bends the flat spring 28 in the cassette ejection direction (direction C).

The locking claw 29 projects from the flat spring 28 in the cassette insertion direction (direction D), its upper surface being an inclined surface 29*a* which slants downward in the cassette insertion direction (direction D). When the paper stack tray 20 is not locked and then is lowered, the end projection 20*a* of the paper stack tray 20 comes into contact with the inclined surface 29*a* of the locking claw 29. If the paper stack tray 20 is further lowered, the flat spring 28 is bent in the cassette ejection direction (direction C), and if the paper stack tray 20 is still further lowered, the end projection 20*a* disengages from the surface 29*a* of the locking claw 29. When this occurs, due to the elastic restoring force of the flat spring 28, the lower surface 29*b* of the locking claw 29 engages with the upper surface of the end projection 20*a* of the paper stack tray 20 so as to lock the paper stack tray 20.

When the paper 6 is to be loaded in the paper cassette 19 having the aforesaid construction, the empty paper stack tray 20 is pushed down by hand against the restoring force of the coil spring 13 (direction B) and the paper is then stacked in the paper stack tray 20, alternatively the paper 6 is first stacked in the paper stack tray 20, and the paper stack tray 20 pushed down by hand against the restoring force of the coil spring 13 (direction B) by pressing on the paper 6. This action engages the end projection 20*a* of the paper stack tray 20 with the lower surface 29*b* of the locking claw 29 so as to lock the paper stack tray 20.

When the locked paper cassette 19 is pressed from the cassette insertion port 31*a* so as to insert it in the cassette receptacle 31*b*, the paper separating tag 10 of the pivot member 25 comes into contact with the supply roller 7, the pivot member 25 pivots in the direction B, the engaging claw 25*a* of the pivot member 25 bends the flat spring 28 in a direction F, the lock of the paper stack tray 20 due to the locking claw 29 is released, the paper stack tray 20 is pivoted upward (direction A) due to the restoring force of the coil spring 13, and the paper 6 is brought into contact with the supply roller 7.

Figure 14:
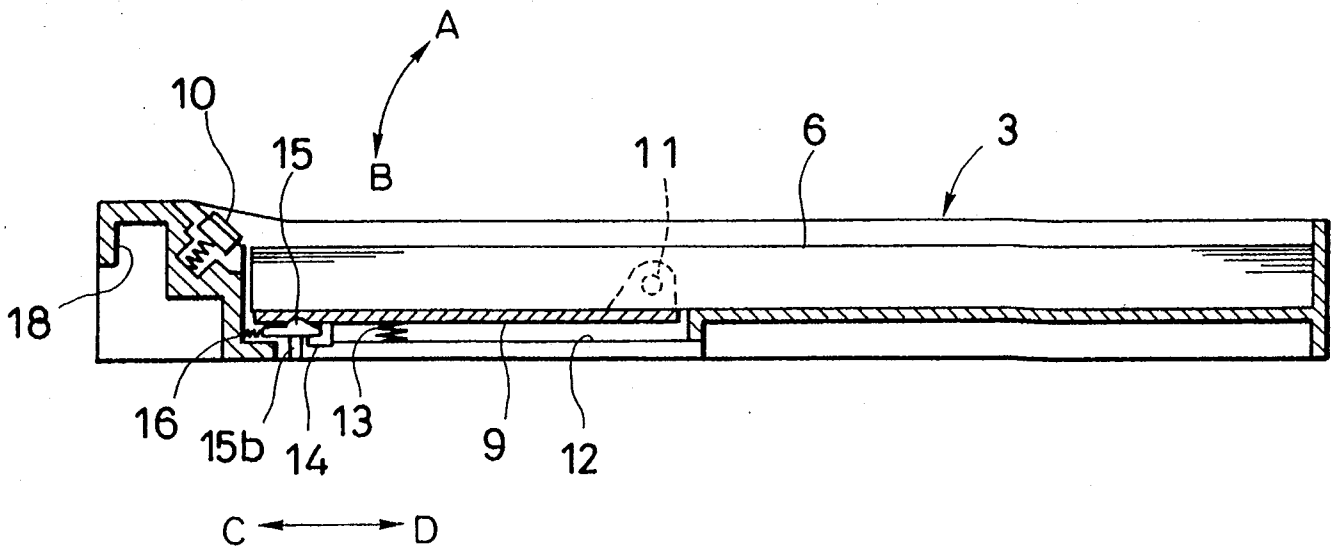
FIG. 14 PRIOR ART
FIG. 14 is a vertical section showing a conventional paper cassette.

In the paper cassette 19 of the present embodiment, as described hereinabove, the stack tray locking mechanism 22 does not use the small coil spring denoted by the reference number 16 of FIG. 14 which tended to suffer fatigue. Instead of these coil springs, the flat spring 28 is used which is bent only for a short time when the paper stack tray 20 is locked or released by the stack tray locking mechanism 22. Hence, the stack tray locking mechanism 22 does not easily break down and the life of the paper cassette is extended.

Further, the mechanism which releases the stack tray lock is the engaging claw 25*a* of the pivot member 25. The lock release member 17 of FIG. 15 which is below the baseplate of the paper cassette is not used, hence printers having such a paper feed mechanism can be made thinner.

Next, a paper cassette insertion mechanism 30 according to the present embodiment will be described with reference to FIGS. 1, 2, and 4–8.

The paper cassette insertion mechanism 30 of this embodiment comprises a cassette receptacle 31*b* of a paper feed mechanism of an electrophotographic printer 31, and a paper cassette 19 which is inserted in this cassette receptacle 31*b*. This paper cassette 19 was described above with reference to FIGS. 1–3, however the paper cassette insertion mechanism 30 hereinbelow described can be applied also to other types of cassette having a different stack tray locking mechanism.

Figure 4:
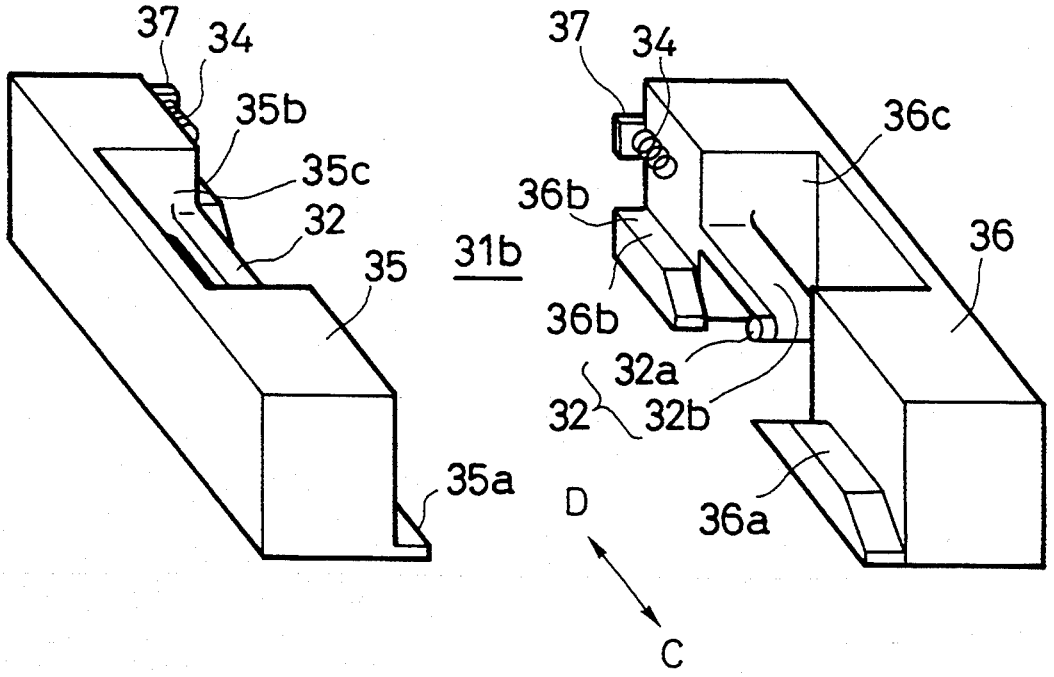
FIG. 4 is a perspective view showing the arrangement of the cassette receptacle of the paper cassette insertion mechanism in FIG. 1.

The cassette receptacle 31*b*, as is best seen in FIG. 4, comprises a pair of guide members 35, 36 which allow the paper cassette 19 to slide over guides 35*a*, 35*b*, 36*a*, 36*b*, and a pair of cassette lock levers 32 respectively provided in recesses 35*c*, 36*c* on the inner surfaces of the guide members 35, 36 and oriented in the same direction (direction D) as that in which the guide members 35, 36 guide the paper cassette 19.

One end of each of the cassette lock levers 32 is fixed on the inner surfaces of the recesses 35*c*, 36*c* of the guide members 35, 36, these levers each comprising a flat spring 32*b* which projects from this end in the cassette ejection direction (direction C) and elastically deforms in a vertical direction, and an engaging member 32*a* which projects inward from a free end of the flat spring 32*b*.

In the cassette receptacle 31*b*, a pair of coil springs 34 are provided, one end of each being attached to a spring post 37 fixed to each guide member 35, 36, and the free end of each being oriented in the cassette ejection direction (direction C). These coil springs 34 push spring lugs 40 fixed to the paper cassette 19 inserted in the cassette receptacle 31*b* in the cassette ejection direction (direction C).

The paper cassette 19 also has a pair of cassette lock cams 33 situated on the outer surfaces of the side walls 19*e*, 19*f*, which respectively engage with the engaging members 32*a* of the cassette lock levers 32.

Figure 6:
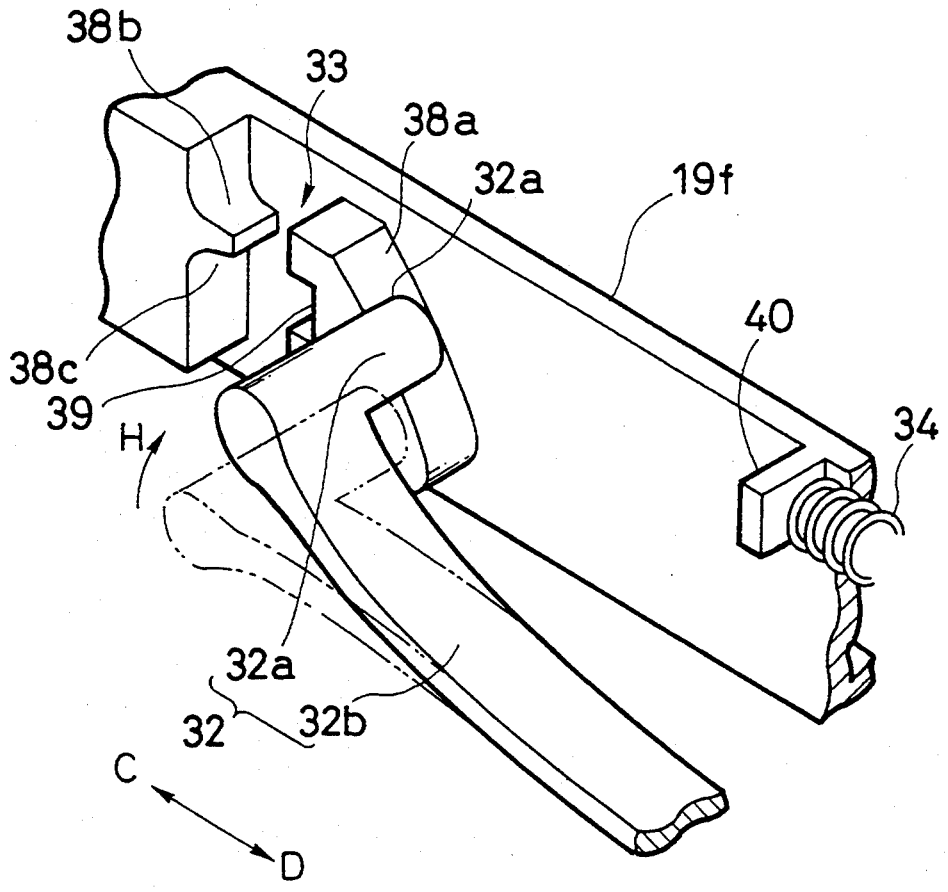

The cassette lock cams 33 each have an inclined cam surface 38*a*. As shown in FIG. 6, when the paper cassette 19 is pushed in by hand from the cassette insertion port 31*a* so as to insert it, it engages with the engaging members 32*a* of the cassette lock levers 32 so as to bend the flat springs 32*b* upward, and when the paper cassette 19 is pushed in to its furthest position against the restoring force of the coil springs 34, the inclined cam surfaces 38*a* release the lock.

The cassette lock cams 33 also have cam surfaces 38*b* which engage with the engaging members 32*a* due to the restoring force of the flat springs 32*b* when the cassette 19 is pushed to its furthest position and the engaging members 32*a* of the cassette lock levers 32 disengage from the cam surfaces 38*a*. After the paper cassette 19 has been pushed to its furthest position, and the user's hand is removed from the paper cassette 19, the paper cassette 19 moves slightly back in the ejection direction (direction C) due to the restoring force of the coil springs 34 so that the cam surfaces 38*b* and the engaging members 32*a* of the cassette lock levers 32 no longer engage with one another.

The cassette lock cams 33 also have recesses 39 which engage with the engaging members 32*a* of the cassette lock levers 32 after they disengage from the inclined surfaces 38*b*. When the engaging members 32*a* are engaged with these recesses 39, the paper cassette 19 is in its inserted position, and the paper 6 is sent one sheet at a time by the supply roller 7.

The cassette lock cams 33 further comprise cam surfaces 38*c* formed directly beneath the cam surfaces 38*b* and cam surfaces 38*d* formed directly beneath the cam surfaces 38*a*. When the engaging members 32*a* of the cassette lock levers 32 are engaged with the recesses 39 and the paper cassette 19 is pushed in the cassette insertion direction (direction D), the engaging members 32*a* of the cassette lock levers 32 disengage from the recesses 39 and come into contact with the cam surfaces 38*c*. When the hand is removed from the paper cassette 19, the paper cassette 19 is pushed out in the ejection direction (direction C) due to the restoring force of the coil springs 34, the engaging members 32*a* come into contact with the cam surfaces 38*d* and the paper cassette 19 is ejected.

Figure 5:
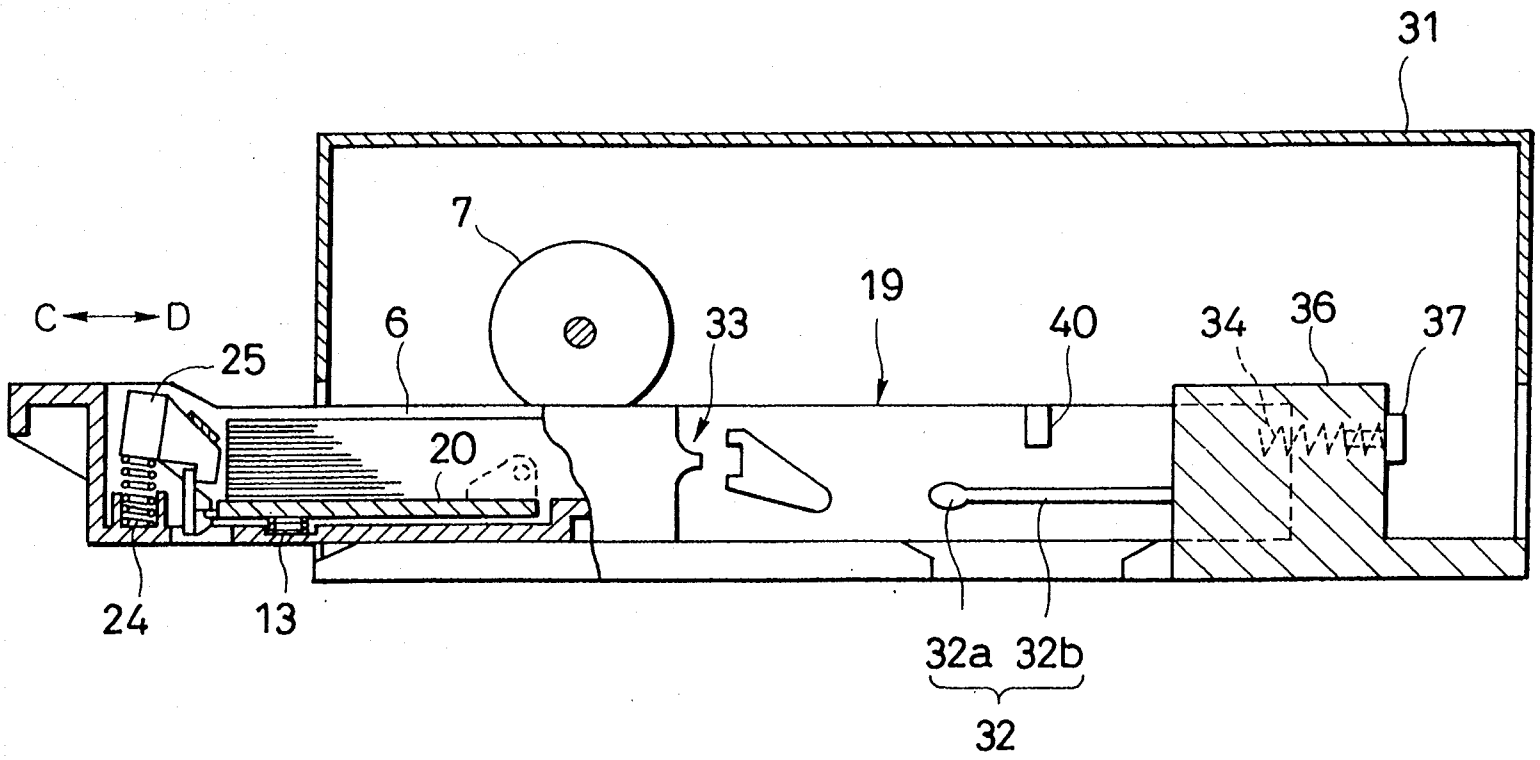
FIGS. 5 to 7 are drawings illustrating how the paper cassette of FIG. 1 is inserted.
Figure 7:
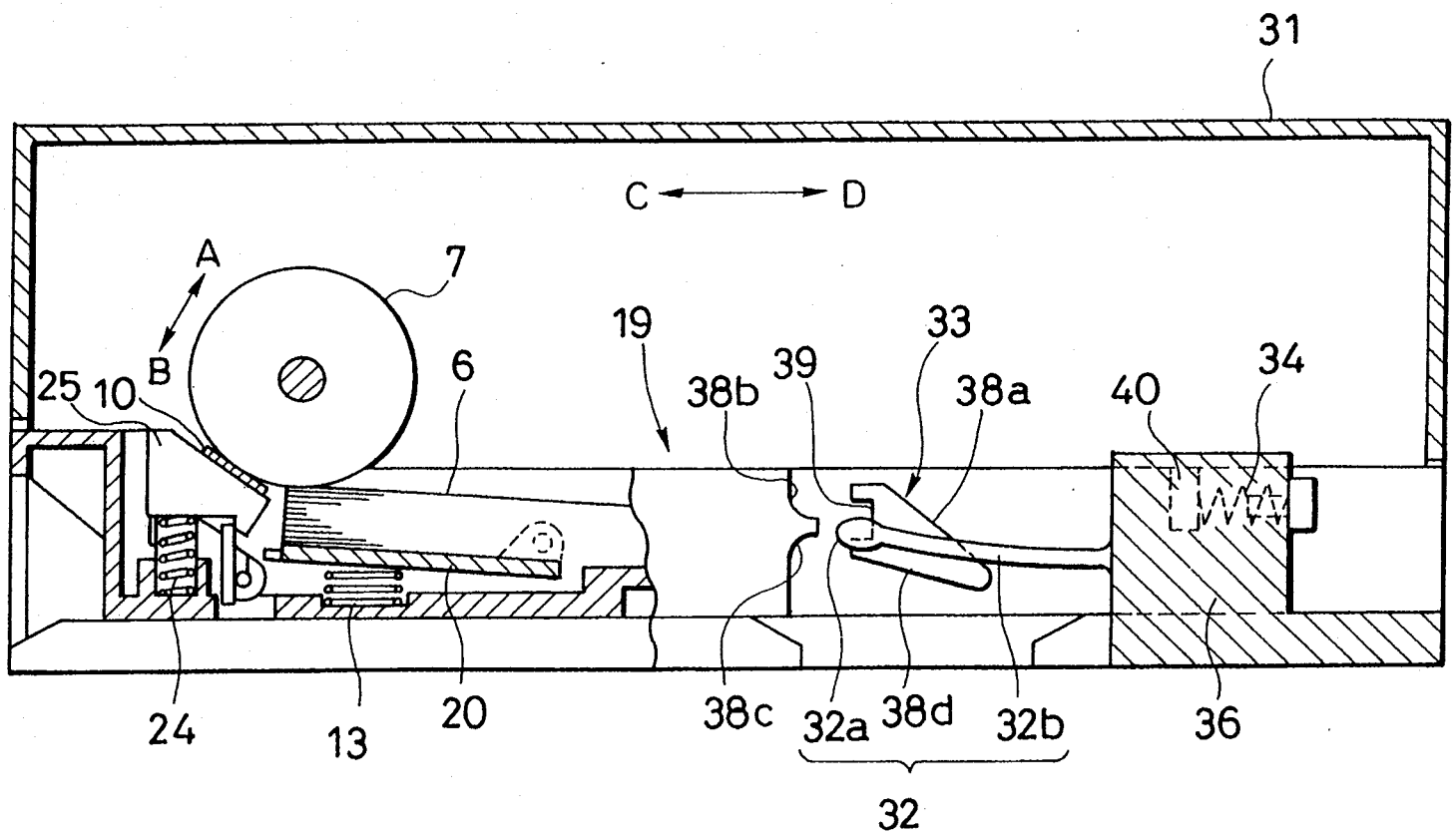

Next, the action of the mechanism for inserting the paper cassette 19 will be described with reference to FIGS. 5–7. After the paper stack tray 20 in which paper is stacked has been locked, the paper cassette 19 is inserted in the insertion direction (direction D) as shown in FIG. 5. In this process, as shown in FIG. 6, the engaging members 32*a* of the cassette lock levers 32 come into contact with the cam surfaces 38*a* of the cassette cam locks 33, and the paper cassette 19 is inserted as the flat springs 32*b* are bent upward (direction H). When the paper cassette 19 is inserted further, the spring lugs 40 on the paper cassette 19 come into contact with the free ends of the coil springs 34 mounted on the cassette receptacle 31*b*, and a restoring force comes to act on the paper cassette 19 in the ejection direction (direction C) due to these coil springs 34. When the paper cassette 19 is pushed still further in against this restoring force, the engaging members 32*a* of the cassette lock levers 32 disengage from the cam surfaces 38*a*, and come into contact with the cam surfaces 38*b*. When the hand is removed from the paper cassette 19, the paper cassette 19 is pushed out slightly in the ejection direction (direction C) due to the restoring force of the coil springs 34, and the engaging members 32*a* of the cassette lock levers 32 engage with the recesses 39 of the cassette lock cams 33 so as to fix the paper cassette 19 in its cassette lock position as shown in FIG. 7.

At this time, the pivot member of the locking mechanism 22 of the cassette 19 pivots in direction B when it comes into contact with the supply roller 7, and the lock of the paper stack tray 20 is thereby released.

Figure 8:
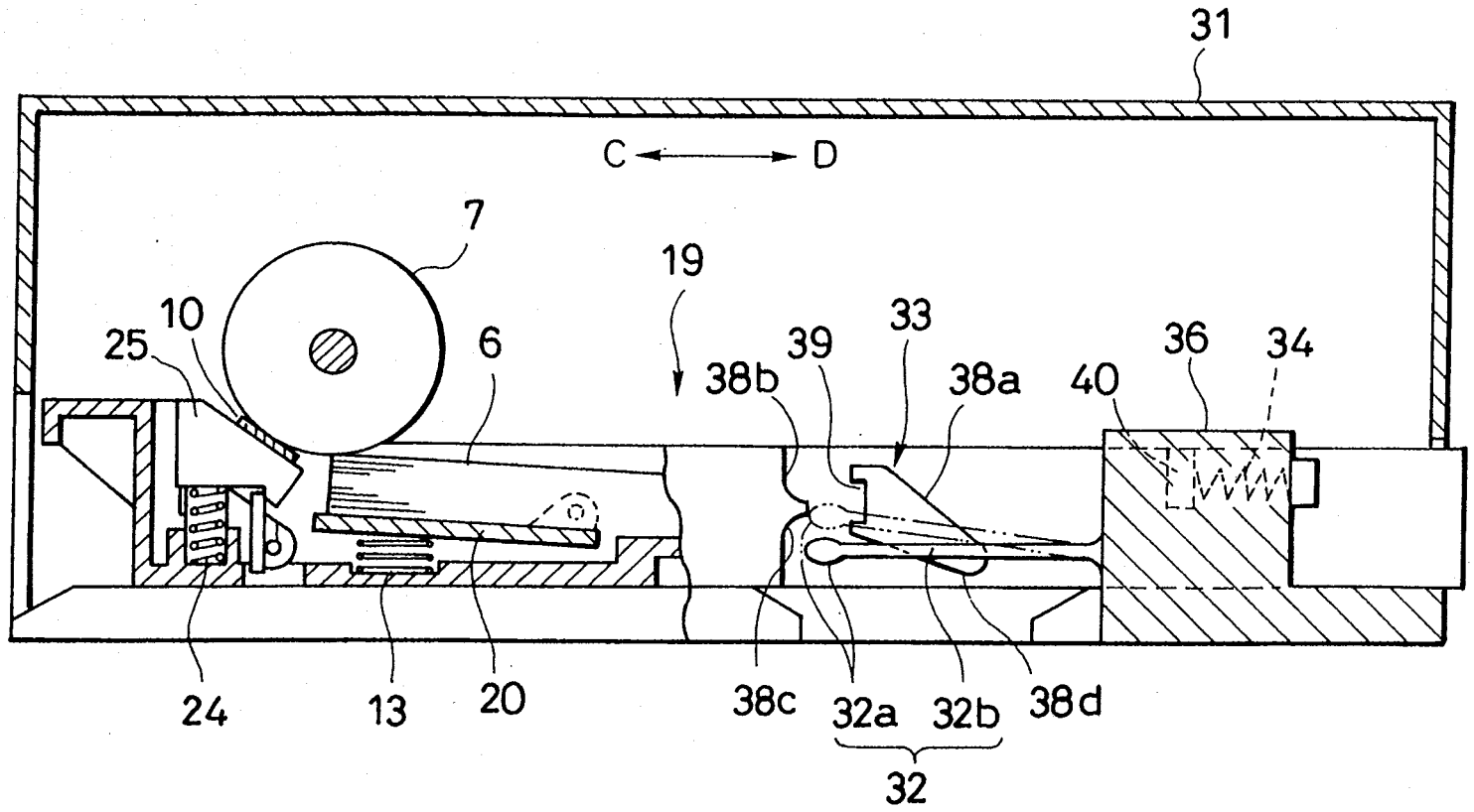
FIG. 8 is a drawing illustrating how the paper cassette of FIG. 1 is ejected.

Next, the ejection mechanism of the paper cassette 19 will be described based on FIGS. 7 and 8. When the paper cassette 19 has been inserted, the engaging members 32*a* of the cassette lock levers 32 are engaged with the recesses 39 of the cassette lock cams 33 as shown in FIG. 7. If the paper cassette 19 is now pushed in again (direction D) and then released, the engaging members 32*a* of the cassette lock levers 32 disengage from the recesses 39 of the cassette lock cams 33, and reach the cam surfaces 38*c* as shown by the double dotted broken line in FIG. 8. When the hand pushing the paper cassette 19 is removed, the paper cassette 19 is then ejected (direction C) due to the restoring force of the coil springs 34. In this process, the engaging members 32*a* of the cassette lock levers 32 move in contact with the cam surfaces 38*d* of the cassette lock cam 33, and then disengage from the cam surfaces 38*d*.

Figure 15:
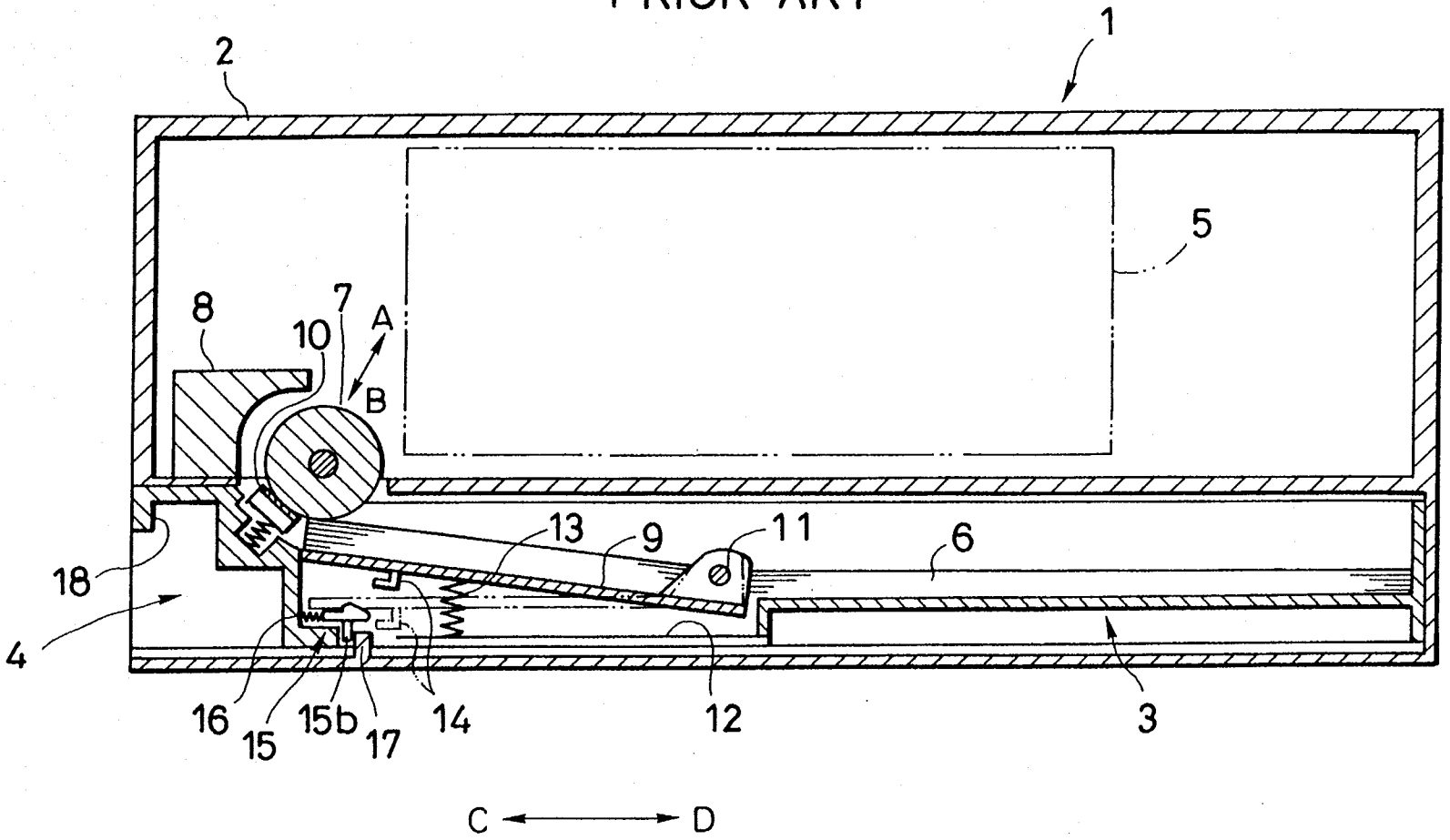
FIG. 15 PRIOR ART
FIG. 15 is a vertical section schematically showing the layout of a conventional electrophotographic printer in which the paper cassette of FIG. 14 is inserted.

As hereinabove described, according to the cassette insertion mechanism of the present embodiment, the inserted paper cassette 19 merely has to be pressed once in order to eject it. The risk of damaging the user's fingers when he pulls out the paper cassette in the conventional device shown in FIG. 15 is therefore completely eliminated.

Next, another embodiment of the paper cassette of the present invention will be described with reference to FIGS. 9–11. Insofar as concerns parts which are identical to those of the cassette shown in FIG. 1 and FIG. 2, reference will be made also to FIG. 1 or FIG. 2.

Figure 9:
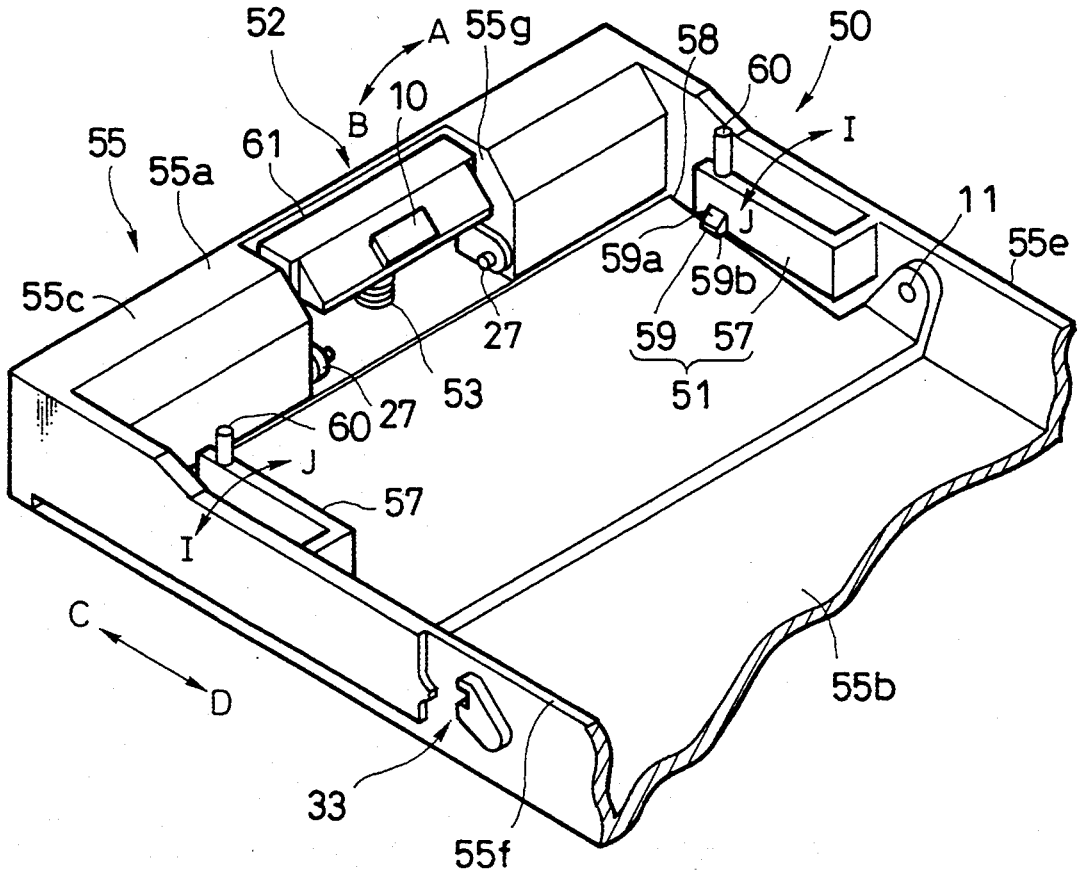
FIG. 9 is a perspective view of the outer aspect of another type of paper cassette according to the present invention.

FIG. 9 is a perspective view of the outer aspect of another type of paper cassette 55 according to the present invention. FIG. 10 is a perspective view showing the arrangement of a cassette receptacle 56*b* in which the paper cassette 55 of FIG. 9 is inserted. FIG. 11 is an enlargement of the essential parts of the cassette receptacle 56*b* of FIG. 10.

When the paper cassette 55 is pressed in from the cassette insertion port 56*a* of the electrophotographic printer 56 in the cassette insertion direction (direction D) as in the case of FIG. 1, it is inserted in the predetermined cassette receptacle 56*b*.

As shown in FIG. 9, the paper cassette 55 comprises a cassette body 55*a* having a baseplate 55*b*, a front wall 55*c*, a rear wall (not shown in the drawing), side walls 55*e*, 55*f*, and a paper stack tray 58 which is able to pivot about a pair of supports 11 respectively fixed opposite each other on the inner surfaces of the side walls 55*e*, 55*f* of the cassette body 55*a*. The paper stack tray 58 is attached such that it is free to pivot about its edge on the cassette insertion side with respect to the cassette body 55*a*, while an edge on the cassette ejection side is situated effectively below the supply roller 7 (identical to reference number 7 in FIG. 1, and not shown in FIG. 9).

The paper cassette 55 comprises a paper separating mechanism 52 situated on the cassette ejection side, a stack tray locking mechanism 50 which locks the paper stack tray 58 in a position near the baseplate 55*b* of the cassette body 55*a* and releases the lock when the paper cassette 55 is inserted in the cassette receptacle 56*a*, and a compressed coil spring (identical to coil spring 13 in FIG. 1, and not shown in FIG. 9) inserted between the baseplate 55*b* of the cassette body 55*a* and the paper stack tray 58. This coil spring pushes the free edge of the paper stack tray 58 toward the supply roller, and when the lock of the stack tray locking mechanism 50 is released, the paper stacked in the paper stack tray 58 is brought into contact with the supply roller.

The paper separating mechanism 52 comprises a pivot member 61 for separating paper which is free to pivot about a pair of supports 27 fixed opposite each other in a central recess 55*g* in the front wall 55*e* of the cassette body 55*a*, a paper separating tag 10 affixed to this pivot member 61, and a compressed coil spring 53 which pushes the pivot member 61 in a direction (direction A) so as to bring the paper separating tag 10 into contact with the supply roller.

Figure 10:
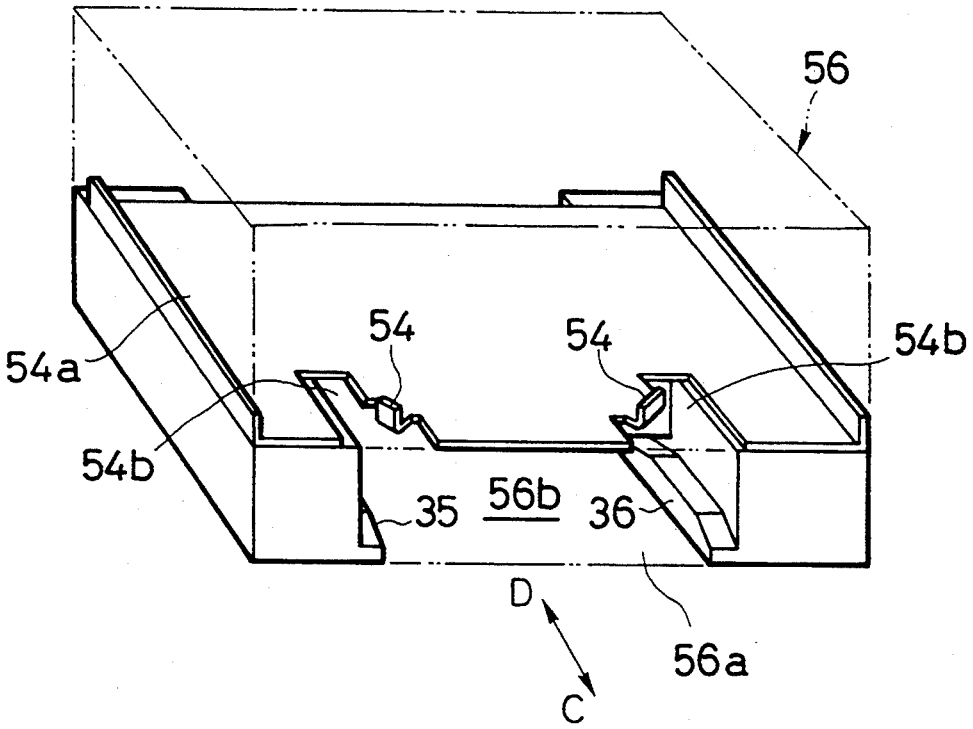
FIG. 10 is a perspective view showing the arrangement of the cassette receptacle in which the paper cassette of FIG. 9 is inserted.

The stack tray locking mechanism 50 comprises a pair of locking members 51 provided on the inner surfaces 55*e*, 55*f* of the cassette body 55*a*, and guide pins 60 which respectively project upward from each of the locking members 51 so that they are in contact with guides 54 on the cassette receptacle 56*b* shown in FIG. 10.

One end of each of the locking members 51 is fixed to the inner surfaces of the side walls 55*e*, 55*f* of the cassette body 55*a*, the members 51 being parallel to the baseplate 55*b* of the cassette body 55*a*, and each comprising a flat spring 57 projecting in the cassette ejection direction (direction C) together with a locking claw 59 on the free end of the flat spring 57 which engages with the paper stack tray 58. The locking claws 59 project from the flat springs 57 toward the inside of the paper cassette 55, and they have upper surfaces 59*a* which incline down toward the inside of the cassette. When the paper stack tray 58 is lowered, it comes into contact with the inclined surfaces 59*a* of the locking claws 59, and when the paper stack tray 58 is further lowered, the flat springs 57 bend toward the side walls 55*e*, 55*f* on which the flat springs 57 are fixed. When the paper stack tray 58 is further lowered so that it disengages from the inclined surfaces 59*a* of the locking claws 59, the lower surfaces 59*b* of the locking claws 59 engage with the paper stack tray 58 due to the elastic restoring force of the flat springs 57.

As shown in FIG. 10, the guides 54 are formed in a pair of cutout areas 54*b* in a plate 54*a* with which the cassette receptacle 56*b* is provided, and when the paper cassette 55 is inserted, the guide pins 60 come into contact with the guides 54. The guides 54 in contact with the guide pins 60 are so oriented that they point away from each other in the cassette insertion direction (direction D). The cutout areas 54*b* engage with the guide pins 60 when they separate from the guides 54.

When paper is to be loaded in the paper cassette 55 having the aforesaid construction, the empty paper stack tray 58 is pushed down directly by hand (direction B) and the paper is then loaded in the paper stack tray 58, alternatively the paper is first placed on the paper stack tray 58 and the paper stack tray pushed down from above the paper (direction B). This action engages the paper stack tray 58 with the lower surfaces 59*b* of the locking claws 59.

When the locked cassette 55 is inserted in the cassette receptacle 56*b* from the cassette insertion port 56*a* , the guide pins 60 of the locking members 50 come into contact with the guides 54 of the cassette receptacle 56*b*, and bend the flat springs 57 respectively toward the side wails 55*e*, 55*f* (direction I). The lock of the paper stack tray 58 due to the locking claws 59 is thereby released, and the paper stack tray 58 pivots upward (direction A) due to the restoring force of the coil spring so as to bring the paper into contact with the supply roller (identical to reference number 7 in FIG. 1).

The paper cassette 55 is then pressed further in, the guide pins 60 of the locking members 50 disengage from the guides 54, the flat springs 57 return to the inside of the paper cassette 55 (direction J), and the paper cassette 55 engages with the recesses 54*a* with the springs not bent. The paper separating tag 10 of the paper separating member 52 is then in contact with the supply roller (identical to supply roller 7 of FIG. 1) due to the restoring force of the coil spring 53.

According to the paper cassette 55 of this embodiment, therefore, the elastic restoring force of the flat springs 57 is used, and the flat springs 57 are bent only during the short times when the cassette 55 is unlocked from the locked state and when it is locked from the unlocked state. The stack tray locking mechanism 22 therefore does not often break down, and the product life of the paper cassette is increased.

Figure 13:
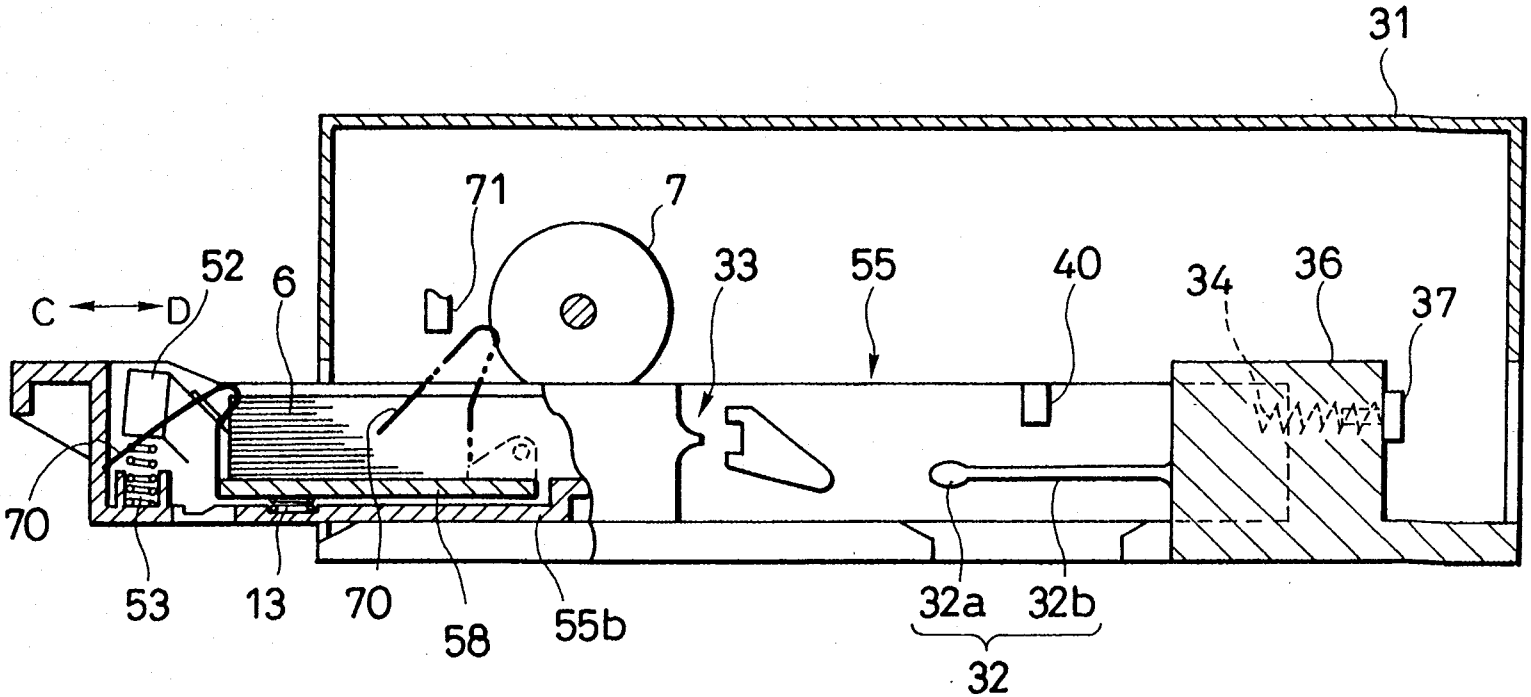
FIG. 13 is a drawing illustrating the action of the additional mechanism of FIG. 12.

Further, as the mechanism which releases the lock of the cassette locking mechanism consists of the guide pins 60 of the locking members 50 and the guides 54 of the cassette receptacle, the part 17 below the baseplate 12 of the cassette as shown in FIG. 13 is not used, so printing devices and the like having a paper feed mechanism can be made thinner.

The cassette of FIGS. 9–11 may also be incorporated in the cassette insertion mechanism described with reference to FIGS. 4–8.

Figure 11:
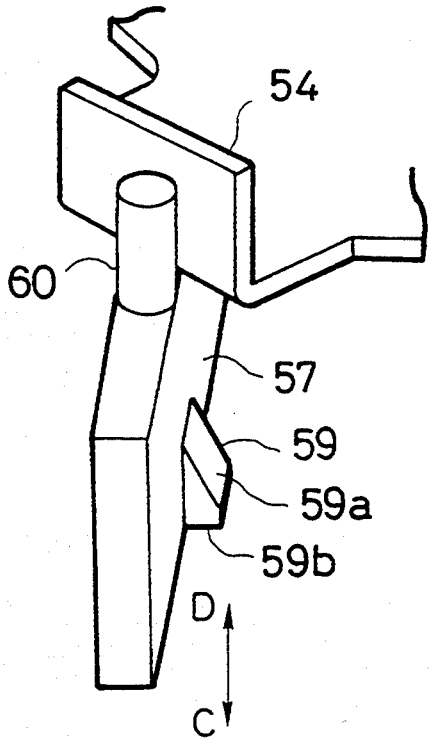
FIG. 11 is an:enlargement of the essential parts of the cassette receptacle of FIG. 10.
Figure 12:
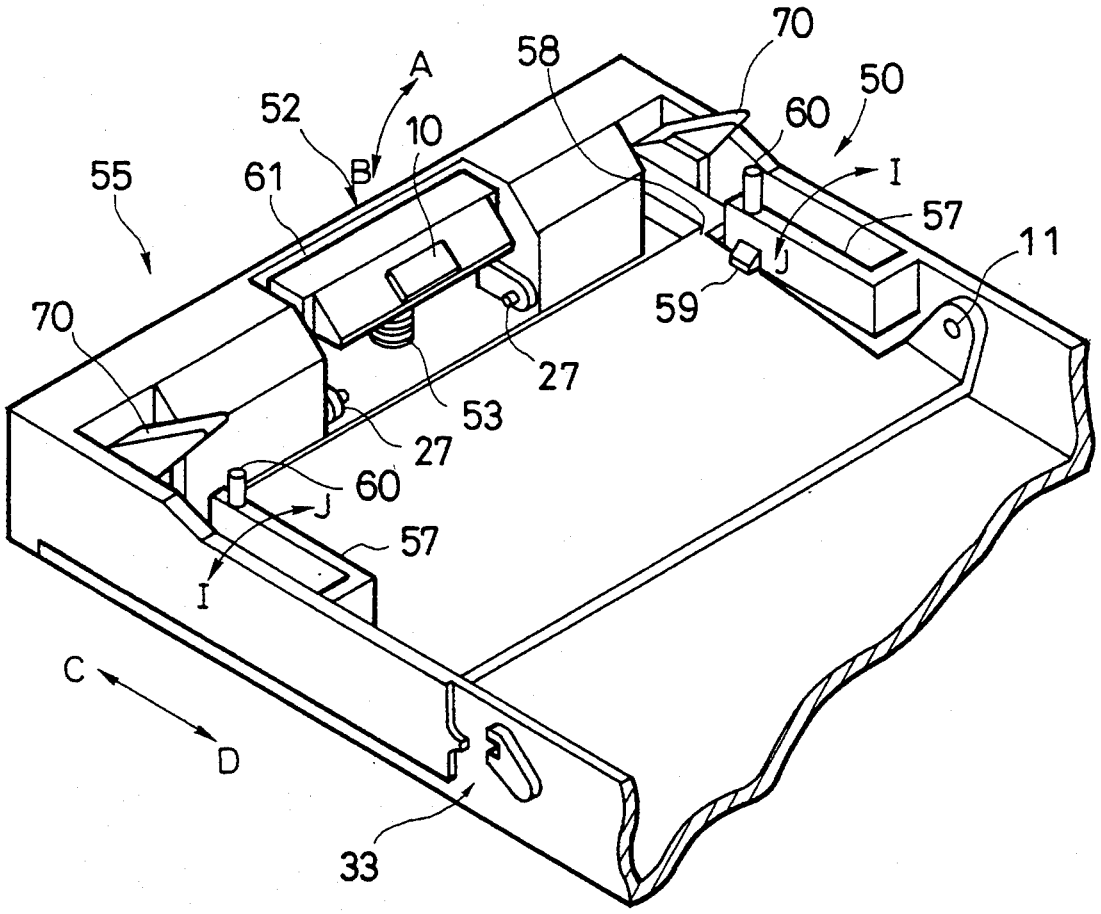
FIG. 12 is a perspective view showing an additional mechanism for locking the paper stack tray when the paper cassette is ejected from the cassette receptacle.

The cassette in FIGS. 1–8, or the cassette in FIGS. 9–11, may be further provided with an auxiliary mechanism 70 to activate the locking mechanism lock the paper stack tray as shown in FIG. 12. This auxiliary mechanism 70, as shown in FIG. 12, consists of a pair of upwardly projecting contact members (projections) on either side of the edge of the paper stack tray 58. When the paper cassette 55 is ejected, the contact numbers 70 comes into contact with contact members 71 fixed to the chassis of the cassette receptacle 56*b* as shown by the double dotted broken line of FIG. 13, and this action moves the stack tray 58 as shown by the solid line in FIG. 13 into position to be locked by the locking mechanism.

This auxiliary mechanism 70 and contact member 71 have been described in the case of the embodiment of FIGS. 9–11, but they may also be applied to the embodiment of FIGS. 1–3.

What is claimed is:

1. An apparatus, comprising:

a paper feed mechanism having a cassette receptacle and a paper cassette which is inserted in said cassette receptacle, said paper cassette being inserted from a cassette insertion port of said cassette receptacle in a predetermined cassette insertion direction;

said cassette receptacle comprising:

a first restoring member provided in said cassette receptacle for pushing said paper cassette in a cassette ejection direction opposite to said insertion direction; and a cassette look lever for fixing said paper cassette at a predetermined position when said cassette lock lever is pushed in the ejection direction by said first restoring member;

said paper cassette comprising a cassette lock cam for engaging with said cassette lock lever, wherein said paper cassette is inserted by pushing it into said cassette receptacle by hand from said cassette insertion port and removing the hand, thereby said cassette lock lever engages with said cassette lock cam; and when said inserted cassette is pushed by hand, said cassette lock lever and said cassette lock cam are disengaged, and when the hand is removed, said paper cassette is ejected from said cassette insertion port due to the restoring force of said first restoring member.

2. An apparatus as defined in claim 1, wherein said paper feed mechanism has a supply roller for supplying paper, said paper cassette further comprising:

a cassette body;

a paper stack tray arranged such that the paper stack tray is free to move with respect to said cassette body;

a stack tray locking mechanism for looking said paper stack tray in a looked condition at a position close to a baseplate of said cassette body, and releasing said paper stack tray from the looked condition when said paper cassette is inserted into said cassette receptacle; and a second restoring member for pushing said paper stack tray toward said supply roller and bringing the paper stacked in said paper stack tray in contact with said supply roller when said paper stack tray is released from the locked condition;

said stack tray locking mechanism comprising:

a pivot member provided on said cassette body such that the pivot member is free to pivot, said pivot member being able to come into contact with said supply roller;

a locking member which engages with said pivot member and engages said paper stack tray in said locked condition; and a third restoring member for pushing said pivot member in such a direction that said pivot member comes in contact with said supply roller so as to engage said locking member with said paper stack tray;

said pivot member coming into contact with said supply roller so as to cause said pivot member to pivot and release the paper stack tray from the locked condition when the paper cassette is inserted into said cassette receptacle.

3. An apparatus as defined in claim 2, wherein said paper stack tray has a cassette insertion side and a cassette ejection side opposite said cassette insertion side, an edge of said paper stack tray on the cassette insertion side being attached to said cassette body such that said paper stack tray is free to pivot, and an edge of said paper stack tray on the cassette ejection side being situated beneath said supply roller.

4. An apparatus as defined in claim 2, wherein said second restoring member is a compressed coil spring provided between the baseplate of said cassette body and said paper stack tray.

5. An apparatus as defined in claim 2, wherein said paper stack tray has a cassette insertion side and a cassette ejection side opposite said cassette insertion side, said stack tray lock mechanism being provided on the cassette ejection side of said paper stack tray:

said locking member comprising a flat spring whereof one end is fixed to said cassette body, said flat spring being parallel to the baseplate of said cassette body and oriented in a direction perpendicular to the cassette insertion direction, and a locking claw provided on a free end of said flat spring, said locking claw engaging with an edge of said paper stack tray on the cassette ejection side; and said pivot member comprising an engaging claw which engages with said flat spring of said locking member;

said locking claw bending said flat spring of said locking member in the cassette ejection direction so as to release said paper stack tray from the locked condition when said pivot member comes into contact with said supply roller and pivots.

6. An apparatus as defined in claim 5, wherein said locking claw projects from said flat spring in the cassette insertion direction, and an upper surface of said locking claw is an inclined surface which slants downward in the cassette insertion direction;

one edge of said paper stack tray coming into contact with said inclined surface of said locking claw when said paper stack tray is lowered, said flat spring bending in the cassette ejection direction when said paper stack tray is further lowered, and a lower surface of said locking claw engaging with the edge of said paper stack tray due to the elastic restoring force of said flat spring when said paper stack tray is still further lowered and disengages from the inclined surface of said locking claw.

7. An apparatus cassette as defined in claim 2, wherein said pivot member comprises a paper separating tag which comes into contact with said supply roller when said paper cassette is inserted into said cassette receptacle.

8. An apparatus as defined in claim 2, wherein said paper stack tray has a cassette insertion side and a cassette ejection side opposite said cassette insertion side, further comprising means for actuating said stack tray locking mechanism when said paper cassette is ejected from said cassette receptacle including a projection projecting upward on said cassette :ejection side of said paper stack tray; and a contact member positioned on said cassette receptacle so that when said paper cassette is ejected from said cassette receptacle, said projection contacts said contact member so as to move said paper stack tray toward the position close to said baseplate.

9. An apparatus as defined in claim 1, wherein said paper cassette further comprises:

a cassette body;

a paper stack tray provided such that the paper stack tray is free to move with respect to said cassette body;

a stack tray looking mechanism for looking said paper stack tray in a locked condition at a position close to a baseplate of said cassette body and releasing said paper stack tray from the locked condition when the paper cassette is inserted into said cassette receptacle; and a second restoring member for pushing said paper stack tray upward and bringing the paper stacked in said paper stack tray in contact with a supply roller when said stack tray locking mechanism is released from the locked condition;

said stack tray locking mechanism comprising:

a first locking member provided on an inner surface of a side wall of said cassette body, said first looking member engaging with said paper stack tray when said paper stack tray is in the locked condition; and a guide pin provided on an upper part of said first locking member which comes into contact with a predetermined part of said cassette receptacle when said paper cassette is inserted, thereby causing said first locking member to slide toward the side wall whereon said first locking member is attached so as to release said paper stack tray from the locked condition.

10. An apparatus as defined in claim 9, wherein an edge of said paper stack tray on the cassette insertion side is attached to said cassette body such that said paper stack tray is free to pivot, and an edge of said paper stack tray on the cassette ejection side is situated substantially beneath the supply roller.

11. An apparatus as defined in claim 9, wherein said second restoring member is a compressed coil spring provided between the baseplate of said cassette body and said paper stack tray.

12. An apparatus as defined in claim 9 further comprising a second locking member, said first and second locking members forming a pair of locking members provided in mutually opposite positions on inner surfaces of side walls of said cassette body, and a pair of said contact members is provided on said cassette receptacle.

13. An apparatus as defined in claim 12, wherein each of said pair of contact members is respectively provided above said paper cassette and respectively has an inclined surface, a space between said inclined surfaces is increased with an advance in the cassette insertion direction.

14. An apparatus as defined in claim 12, wherein said locking members each comprise:

a flat spring whereof one end is fixed to an inner surface of the side wall of said cassette body, said flat spring is parallel to the baseplate of said cassette body, and said flat spring is oriented in the cassette ejection direction; and a locking claw attached to a free end of said flat spring which engages with said paper stack tray.

15. An apparatus as defined in claim 14, wherein said locking claw projects from said flat spring away from the inner surface to which said flat spring is fixed;

an upper surface of said locking claw slants downward away from said inner surface; and said paper stack tray comes into contact with said inclined surface of said locking claw when said paper stack tray is lowered, said flat spring bending toward the side wall whereon said flat spring is provided when said paper stack tray is further lowered, and a lower surface of said locking claw engaging with said paper stack tray due to the elastic restoring force of said flat spring when said paper stack tray is still further lowered and disengages from the inclined surface of said locking claw.

16. An apparatus as defined in claim 9, wherein said paper stack tray has a cassette insertion side and a cassette ejection side opposite said cassette insertion side further comprising means for actuating said stack tray locking mechanism when said paper cassette is ejected from said cassette receptacle, including a projection projecting upward on said cassette ejection side of said paper stack tray; and a contact member positioned on said cassette receptacle so that when said paper cassette is ejected from said cassette receptacle; said projection contacts said contact member so as to move said paper stack tray toward the position close to said baseplate.

17. An apparatus as defined in claim 1, wherein said cassette lock lever comprises:

a flat spring whereof one end is fixed to an inner surface of a side wall of said cassette receptacle, said flat spring being oriented from the end in the cassette ejection direction and elastically deforming in a perpendicular direction; and a projection attached to a free end of said flat spring which engages with said cassette lock cam.

18. An apparatus as defined in claim 17, wherein said cassette lock lever comprises a pair of cassette lock levers on opposite side walls of said cassette receptacle, said cassette lock cam including a pair of cassette lock cams provided on side walls of said paper cassette on surfaces opposite to said cassette look levers, and each of said pair of cassette lock cams comprises:

a first cam surface which engages with said projection of said cassette lock lever when said paper cassette is inserted by hand from the cassette insertion port of said cassette receptacle so as to bend said flat spring, and disengages from said projection when said cassette is pushed to its furthest position;

a second cam surface which engages with said projection of said cassette lock lever when said paper cassette is pushed to its furthest position so that said projection of said cassette lock lever disengages from said first cam surface, and disengages from said projection of said cassette lock lever when said paper cassette is pushed to its furthest position and the hand is removed so that the cassette moves back slightly in the ejection direction due to said restoring member; and a recess which engages with said projection of said cassette lock lever which has disengaged from said second cam surface.

19. An apparatus as defined in claim 18, wherein when said paper cassette is pressed in the insertion direction after said projection of said cassette lock lever has disengaged from said second cam surface and engaged with said recess, said projection disengages from said recess, and when the hand is removed from the paper cassette, the paper cassette is pushed out in the ejection direction due to said restoring means.

20. An apparatus as defined in claim 19, wherein said cassette lock cam further comprises:

a third cam surface which comes into contact with said projection after said cassette is pressed in the insertion direction and then said projection of said cassette lock lever has disengaged from said recess; and a fourth cam surface which comes into contact with said projection after the hand is removed from said paper cassette and then said paper cassette is pushed out in the ejection direction due to said restoring means.

21. An apparatus comprising:

a paper feed mechanism having a cassette receptacle, said receptacle having walls and an insertion port in said walls; and a paper cassette which is inserted in said receptacle through said port in a predetermined cassette insertion direction, wherein said receptacle includes restoring means, fixed to said walls, for pushing said cassette in a cassette ejection direction opposite to said cassette insertion direction, and a cassette lock lever fixed to said walls, wherein said cassette includes a cassette lock cam that slidably engages said lever when said cassette is pushed into said receptacle from said port with a first pushing force and lockingly engages said lever to fix said cassette at a predetermined position when the first pushing force is removed, wherein said cam and said lever are responsive to a second pushing force on the inserted cassette to disengage from each other, and wherein a restoring force of said restoring means ejects the inserted cassette from said port when the second pushing force is removed.

* * * * *